US005307964A

United States Patent [19]

Toth

[11] Patent Number: 5,307,964

[45] Date of Patent: May 3, 1994

[54] AEROSOL EXTENSION

[75] Inventor: John B. Toth, 11685 W. 25th Ave., Lakewood, Colo. 80215

[73] Assignee: John B. Toth, Arvada, Colo.

[21] Appl. No.: 828,719

[22] Filed: Jan. 31, 1992

[51] Int. Cl.[5] ..... B65D 83/20

[52] U.S. Cl. ..... 222/402.13; 222/527

[58] Field of Search ..... 222/182, 402.13, 526-538, 222/562-570

[56] References Cited

U.S. PATENT DOCUMENTS

| | | | |
|---|---|---|---|
| 3,091,367 | 5/1963 | Fredrickson | 222/402.13 X |
| 3,138,331 | 6/1964 | Kutik | 222/182 X |
| 3,154,075 | 10/1964 | Weckesser . | |
| 3,186,645 | 6/1965 | Eberlein | 222/567 X |
| 3,276,641 | 10/1966 | Lehmann | 222/526 |
| 3,510,028 | 3/1969 | Batistelli . | |
| 4,023,711 | 5/1977 | Sena . | |
| 4,096,974 | 6/1978 | Haber et al. | 222/530 X |
| 4,660,745 | 4/1987 | Hess . | |
| 4,838,456 | 6/1989 | Hamlin | 222/402.13 X |
| 5,203,841 | 4/1993 | Kitabayashi | 222/507 X |

*Primary Examiner*—Andres Kashnikow

*Assistant Examiner*—Kenneth DeRosa

*Attorney, Agent, or Firm*—Ken Richardson

[57] ABSTRACT

Disclosed is an aerosol extension for use with a pressurized container in domestic, industrial and general spray applications. The pressurized container includes a cylindrically-shaped body, a planar bottom and a convex top. The body includes a propellant and a product to be dispensed therefrom. The top has a circular opening for receiving an actuator and a dispensing valve. The actuator and dispensing valves defines a dispensing system for delivering the product as a spray, a mist, a stream or a powder. The actuator, in turn, defines an outlet orifice for delivering the product held within the pressurized container. The improvement comprises a clamping member, which is joined and releasably locked to the dispensing system. A flexible, elongated, tubular member is provided for accurately delivering products contained in the pressurized container from the dispensing system to intended locations otherwise difficult to reach with the products. The tubular member is adjustably coupled between the clamping member and the dispensing system to effect efficient delivery of the products.

17 Claims, 3 Drawing Sheets

AEROSOL EXTENSION

This invention relates generally to pressurized aerosol-spray containers, and more particularly, to extensions for aerosol spray nozzles and dispensing valves.

A remarkable number of domestic, industrial, pharmaceutical and general activities utilize products dispensed or sprayed from pressurized containers commonly known as aerosol. As used herein an aerosol involves a container and a method of dispensing. Thus, an aerosol container concerns products in a form of fine solids or liquid particles packaged in a pressurized-sealed container with a liquified or compressed gas propellant to enable the products to self-dispense by opening a valve. A limited example of aerosol products dispensed in domestic, industrial, general and pharmaceutical applications are: toiletries, room deodorants and food products for domestic applications; insecticides, lubricants, oils, detergent cleaners, paint fuels, fibers and insulation products for industrial and general applications; and chemicals products for pharmaceutical applications.

In all of the above applications, convenience has usually been a primary consideration to justify a high cost of a pressurized gas delivery system of aerosols relative to the product ingredients. Because of convenience, aerosols have enjoyed universal acceptance and great commercial success. However, one of the problems with aerosol spray systems are an undesirable amount of product and propellant waste when a physical size or geometry of the container, or when the spray dispensing and distribution process, does not allow the product to accurately and satisfactorily reach an intended location. For example, such waste frequently occurs in spray lubricating applications when servicing compact, tightly assembled components of automotive systems, marine motor systems, or aircraft engine systems with aerosols.

Well known prior art, aerosol, extension devices and associated product dispensing methods involve Batestelli, U.S. Pat. Ser. No. 3,510,028 (1970), which discloses a pole handle extension for holding an aerosol container at one end, and controlling a discharge of fluid from the container with an actuator provided adjacent the pole handle. Further, Sena, U.S. Pat. Ser. No. 4,023,711 (1977) discloses an extension, which is used for holding paint spray devices. Similarly, Hess Jr., U.S. Pat. Ser. No. 4,660,745 (1987) discloses a remote actuator or an aerosol can comprising an elongated rod having a jaw structure at one rod end for gripping a neck of the aerosol can. Finally, Weckesser, U.S. Pat. Ser. No. 3,154,075 (1964) disclosed a vaginal applicator for mounting on an external valve stem of a pressurized fluid container.

Unfortunately, there are major disadvantages associated with some of the foregoing prior art extension devices and product dispensing methods. One disadvantage is that some are not practical, when direct transfer of the product from a nozzle or a valve orifice of the aerosol container to the extension is required for precise placement of the dispensed product at an intended location with minimal product and propellant waste. Another problem with some is that the extension, which focuses and extends a range of the dispensed products, is not flexible. Thus, accurate dispensing of the products is often impeded by a physical rigidity and a geometry of the extension. Other disadvantages are that some are relatively complex and costly to manufacture.

Additional objects, advantages and novel features of the aerosol extension invention will be set forth in part in descriptions, which follow, and in part will become apparent to those skilled in the art upon examination of the following descriptions, or may be learned by practice of the invention. The objects and advantages of the invention may be realized and attained by means of the aerosol extension components and combinations particularly pointed out in the appended claims.

It is a general object of the invention to provide an aerosol extension for use in industrial, domestic and general spray applications that overcomes many of the problems and disadvantages of prior art aerosol valves, nozzles, atomizers or actuators.

It is another general object to provide a reliable, low cost, flexible, lightweight, durable, aerosol extension that is virtually nonreactive with an aerosol product.

It is a specific object to provide an aerosol extension for use in industry, domestic and general applications that efficiency and precisely delivers an aerosol product to desired locations otherwise difficult to reach with the product.

It is another specific object to provide an aerosol extension that allows an aerosol product to be delivered through an extension at a satisfactory spray rate and in a form expected by an user.

It is still a specific object to provide an aerosol extension that directly connects and releasably locks to the aerosol nozzle, actuator or valve system, and that satisfactorily transfers an aerosol product therethrough with substantially no undesired leakage.

It is yet a specific object to provide an aerosol valve extension that is compatible with numerous aerosol nozzles, actuators, or valves having different shapes or geometries.

To achieve the foregoing and other objects and in accordance with the purpose of the aerosol extension invention, as embodied and broadly described herein, this invention comprises an extension for use with a pressurized container in domestic, industrial and general spray applications. The pressurized container has a cylindrically-shaped body, a planar bottom and a convex top. The body includes a propellant and a product to be dispensed therefrom. The top has a circular opening for receiving an actuator and a dispensing valve, which actuator and valve defines a dispensing system for delivering the product as a spray, mist, stream or powder. The actuator, in turn, defines an outlet orifice for delivering the product held within the pressurized container. The improvement comprises a clamping means that is directly joined and releasably locked to the dispensing system. The extension further comprises a flexible, elongated tubular member for accurately delivering products contained in the pressurized container from the dispensing system to intended locations otherwise difficult to reach with the products. The tubular member is coupled between the clamping means and the dispensing system to effect efficient delivery of the product contained within the pressurized container.

The accompanying drawings, which are incorporated in and form a part of the specification, illustrate preferred embodiment(s) of the aerosol extension invention and, together with the description, serve to explain the principles of the invention. In the drawings.

Figure 1:
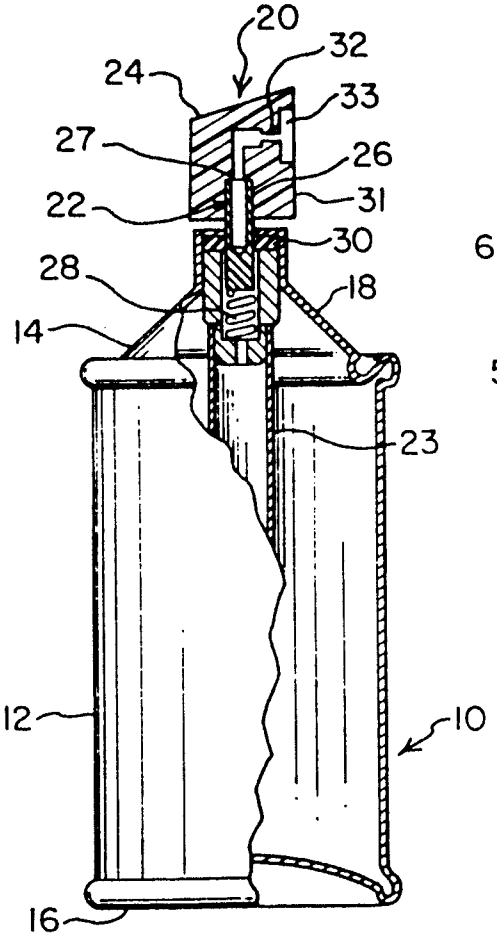
FIG. 1 (PRIOR ART)
FIG. 1 is a partially broken, partially sectioned, front view of a prior art aerosol.

Referring now to FIG. 1, a prior art pressurized container or aerosol 10 is shown for pressure dispensing products contained therein as a stream, mist, spray, powder, paste or foam. Notably, the present invention contemplates dispensing-products such as lubricants, cleaners and paints for domestic, industrial and general applications. However, other products that may also be dispensed with aerosol 10 include toiletries, food, pharmaceuticals, insecticides and animal products.

Aerosol 10 in its most typical form comprises a pressurized, can-like package or body 12 for holding the product to be dispensed in a liquid-gas, propellant dispersion or suspension. Body 12 is usually formed from a metal alloy, glass or plastic, and includes a convex or dome top 14 and a concave or flat bottom 16. Convex top 14 is provided with an opening 18 for receiving a product and a gas propellant, and for allowing connection of an atomizer or spray, dispensing system. The dispensing system is generally denoted by the reference numeral 20, and it caps or closes opening 18, retains a required gas pressure within body container 12, and dispenses the product as a spray, a mist, a stream, a foam, a paste or a powder at a designed pressure rate.

In the present instance, dispensing system 20 is defined by a dispensing valve, generally denoted by reference numeral 22, and an actuator, a nozzle, or an atomizer 24. Dispensing valve 22 includes a plastic dip tube 23 for conveying the product from body container 12 to actuator 24. Tube 23 connects to a movable plastic stem 26, which has an opening 27 for metering a flow of the product from aerosol 10. Stem 26 in conjunction with a spring 28 and a rubber gasket 30 provide a mechanism for opening, closing and sealing dispensing system 20.

Although a geometry or configuration of prior art actuators is based on characteristics of a desired form of delivery, e.g., spray or stream, all actuators 24 will normally contain a final passageway or outlet orifice 32 for producing or projecting a spray, mist, stream, foam, paste or powder for an intended application in a pattern defined by its construction. Outlet orifice 32 is mechanically, removably linked with stem 26 to provide an off-on control. Delivery of an aerosol product is initiated by tilting actuator 24 forward, or by vertically depressing actuator 24.

For the aerosol 10 illustrated, orifice outlet 32 is provided with bell-shaped terminal end in the form of an enlarged circular recess or hollow chamber 33. Except for the slot or chamber formed by interior chamber 33, actuator 24 comprises a generally flat, external face 31. Chamber 33 is of a size or dimension to match with a corresponding component tubular extension of the invention, as will be more fully explained hereinafter.

Figure 2:
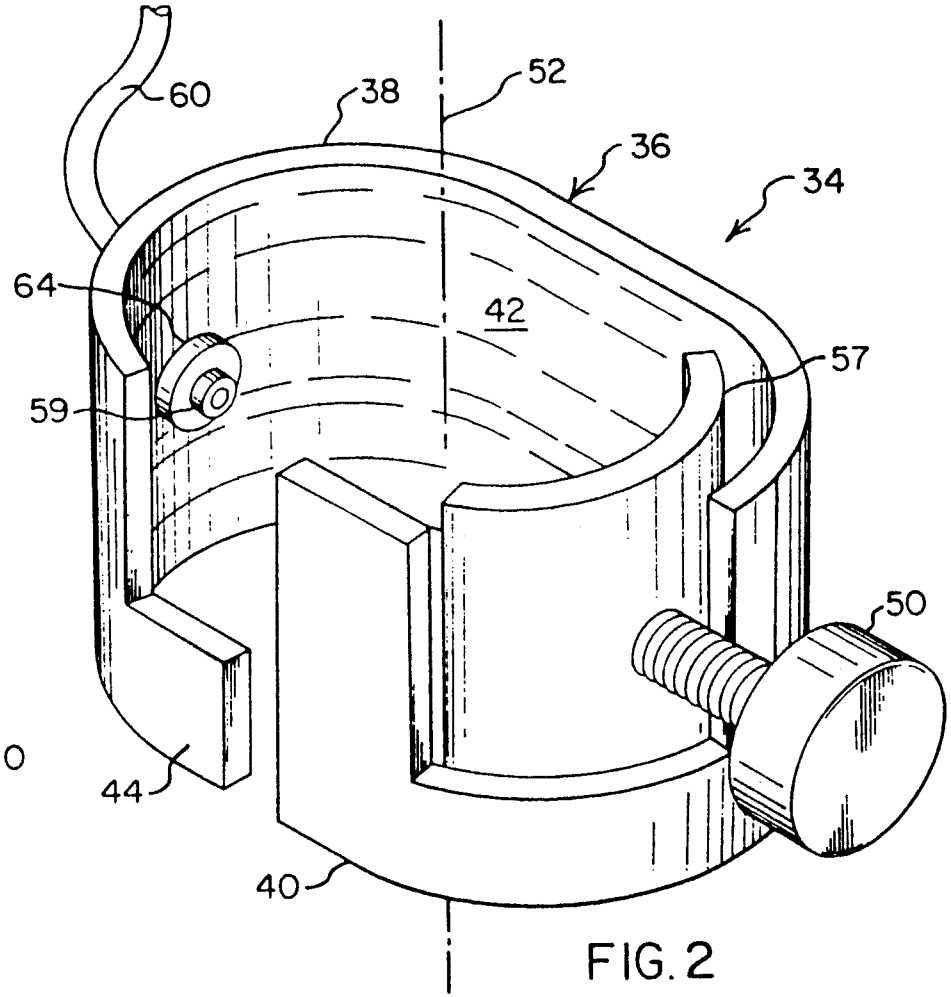
FIG. 2 is an enlarged, partially broken, perspective view of an aerosol extension constructed in accordance with the invention.
Figure 3:
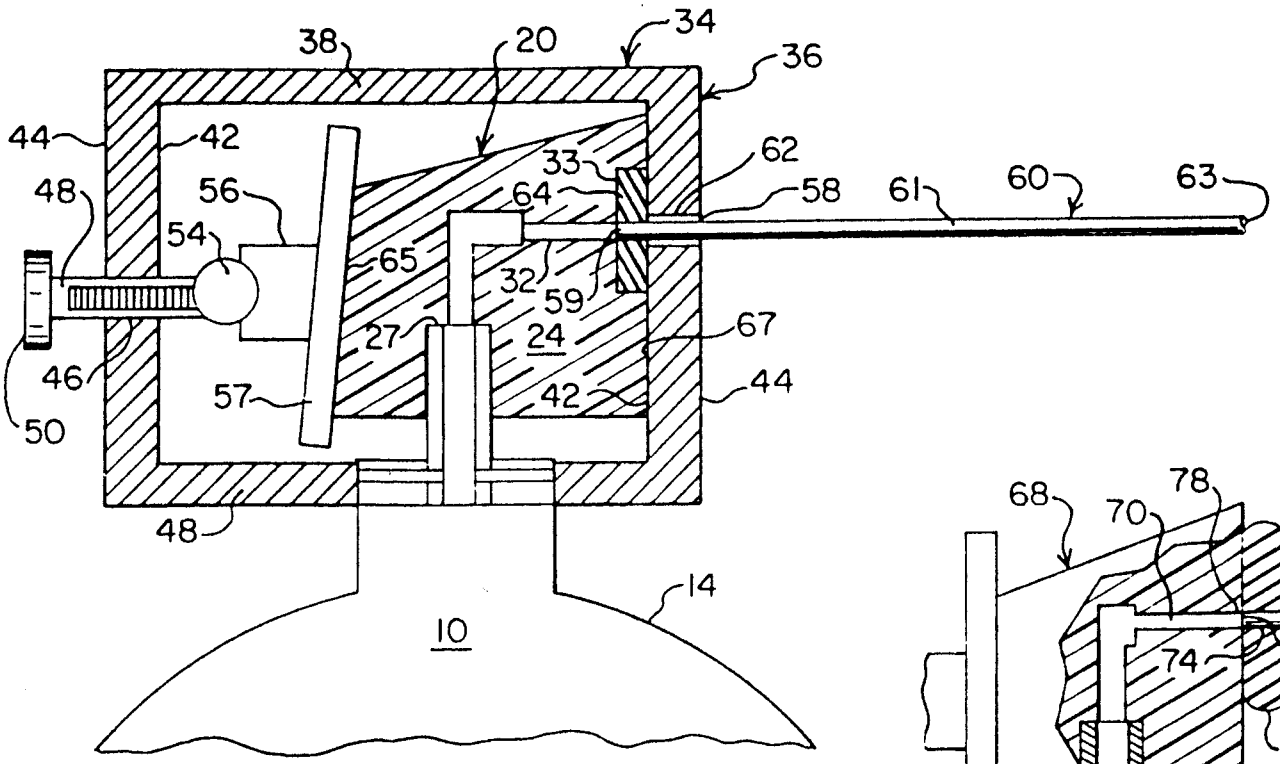
FIG. 3 is an enlarged, fragmentary, partially broken, cross-sectional view of the aerosol extension of FIG. 1, illustrating the aerosol extension locked to a spray system of the aerosol of FIG. 1.

Turning now to FIGS. 2 and 3, there is shown one preferred embodiment of the invention in the form of an aerosol extension for use with prior art pressurized aerosols 10 in industrial, domestic and general applications, which extension is generally denoted by the reference numeral 34. Extension 34 comprises a ring-shaped clamp or collar 36 for releasably, positively, locking extension 34 directly to dispensing system 20 of aerosol 10, without requiring physical engagement with aerosol top 14, body 12 or bottom 16.

In the illustrated form, clamp 36 preferably comprises a lightweight, durable, rigid, plastic material that is substantially resistent to aerosol product attack. Clamp 36 includes opposed top and bottom sides 38 and 40, respectively, and opposed inner and outer sides 42, 44. Clamp 36 further comprises a threaded aperture 46 extending in a radial direction through inner and outer clamp sides 42, 44, as is best shown in FIG. 3.

Pursuant to the invention, threaded aperture 46 receives an adjusting screw 48 for connecting a button or a sleeve member 57 thereto. A head 50 of adjusting screw 48 is provided with a knurled configuration to facilitate manually, controllably moving, adjusting screw 48 towards or away from an imaginary axially extending centerline 52 of clamp 36, as is best shown in FIG. 2. An end of adjusting screw 48 opposite head 50 is provided with a ball means 54, which mates with a socket 56 provided by sleeve member 57.

Sleeve 57 is positioned adjacent inner clamp side 42, and is enabled to pivot in all directions through the ball 54 and socket 56 connection. Sleeve 57 is in the form of a button, as previously mentioned, or a plate or disk and preferably comprises a rectangular thin plate, having a concave or curved shape. Sleeve 57 further comprises a lightweight, rigid, plastic material that is substantially resistant to aerosol product attack.

In keeping with the invention, clamp 36 further comprises a second aperture 58 for retaining an elongated, flexible, slender, annular or tubular extension member therein, generally denoted by reference numeral 60. Tubular member 60 preferably comprises an aerosol, product-resistent, plastic material, such as, polyethylene or polypropylene. Tubular member 60 extends through inner and outer clamp sides 42, 44 so as to define an inlet or intake terminal end portion 59, an intermediate portion 61, and an outlet terminal end portion 63. Tubular member 60 is provided with a diameter suitable for insertion within outlet orifice 32 of dispensing system 20 to allow aerosol products to be transferred by dispensing system 20 therethrough. Tubular member 60 is also comprises a length suitable for allowing aerosol products to be transferred thereby to locations otherwise difficult to reach with said products. A preferred length of tubular member 60 is around about two feet.

It will be appreciated that aperture 58 may be provided with a locking bushing, retainer ring, or sleeve 62 for reducing the diameter of aperture 58, as illustrated in FIG. 3. The reduced diameter effects positively securing tubular member 60 at aperture 58 with respect to preventing movement thereof, and assists in coupling terminal inlet portion 59 of tubular member 60 to outlet orifice 32. Incidentally, bushing 62 comprises a material suitable for minimizing damage to tubular member 60.

In accordance with the invention, tubular member 60 has disposed thereon an inner, ring-shaped gasket 64 for forming a connection at a terminal inlet end 59 and outlet orifice 32. It will be noted that this connection is resistant to an unwanted leakage of propellants and products transferred from aerosol 10 to tubular extension member 60, when terminal tube inlet 59 is locked into abutting engagement at orifice 32. To provide a leak-resistant seal, gasket 64 comprises a resiliently compressible, material and preferably is made of rubber. Gasket 64 is mounted over tubular end 59 and secured thereto in a manner to prevent movement thereof, as well as being mounted to engage inner clamp surface 42. More specifically, gasket 64 is retained by tubular end 59 between inner clamp surface 42 and an adjacent confronting surface defined by outlet orifice 32. So positioned, gasket 64 is permitted to abuttingly engagement outlet orifice 32, as will be more fully explained hereinafter.

In operation, collar 36 of extension 34 is initially position over the dispensing system 20 of a prior art aerosol container 10 to enable the aerosol product to be transferred through tubular member 60 to a normally hard to reach location at a satisfactory rate and in the form desired by the user. For example, aerosol products conveyed by tubular member 60 may be in the form of a spray, mist, stream or powder.

Thereafter, adjusting screw head 50 is manually tightened or torqued to exert a squeezing or compression force or pressure on opposed front and back regions 67, 65, respectively, of actuator 24 and on confronting regions of sleeve member 57 and inner surface 42. More specifically, a pressure is exerted on sleeve 57 as adjusted screw 48 is advanced in a radial direction through threaded aperture 46. The thrust of the pressure is taken up by sleeve 57 and is transmitted to front and back regions 67, 65 of dispensing system 20 at actuator 24. The ball 54 and socket 56 connection allows the force absorbed by sleeve 57 to be transmitted thereby in all directions to front and back actuator regions 67, 65. Moreover, the absorbed force is transmitted to inner clamp surface 42 around a region defined by clamp aperture 58, as well as transmitted to terminal inlet tubular end 59 and to opposed side surfaces of gasket 64, while gasket 64 is sealed within chamber 33 of orifice 32.

Next, before positively locking aerosol extension 34 and tubular member 60 to dispensing system 20, tubular end 59 is inserted within orifice chamber 33. Incidentally, it is to be noted that gasket 64 is positioned on tubular member 60, such that, upon insertion of tubular end 59 within orifice chamber 33, gasket 64 is also seated therein. A final adjustment of tightening screw 48 lockingly maintains tubular member 60 in alignment with orifice 32. It will be further noted that the final adjustment also causes inner surface 42 at aperture region 58 to bear against gasket 64, in a manner to compress gasket 64 within orifice chamber 33. So compressed, gasket 64 assists locking screw 48 in maintaining tubular member 60 in line with orifice 32, and forms a joint that is resistant to liquid, gas or powder leaks, while leaving actuator 24 free for starting and stopping product dispensing or spray operations.

Figure 4:
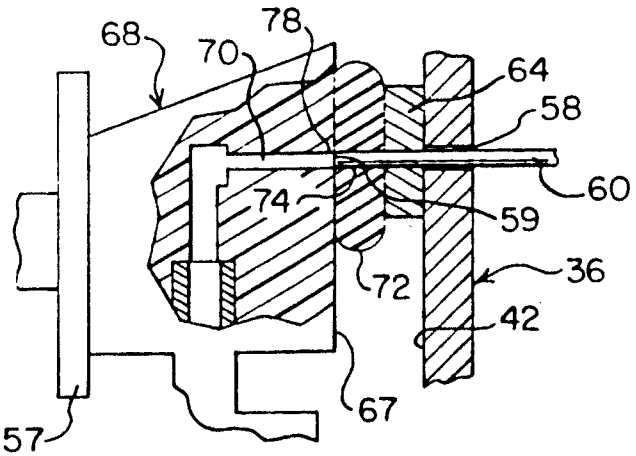
FIG. 4 is an enlarged, fragmentary, partially broken, cross-sectional view of another actuator, in which an outlet orifice thereof has a single uniform size, and in which a connection of a tubular extension member of the aerosol extension to the outlet orifice is a variant of a connection of the tubular extension member of the aerosol extension to the outlet orifice of the actuator of FIG. 1.

Turning now to FIG. 4, there is shown another conventional actuator, generally denoted by the reference numeral 68, which is used by aerosol 10 and which has an outlet orifice geometry 70 that is a variant of orifice 32 of FIG. 1. It will be appreciated, however, that the configuration of outlet orifice 70 comprises a common and well known design used by a number of different aerosol manufactures. The only difference between outlet orifices 32 and 70 is that outlet orifice 70 does not terminate in an enlarged hollow chamber. Instead, outlet orifice 70 generally comprises a single uniform diameter so as to provide the front or face 67 of actuator 68, from which the product is delivered, with a non-slotted or generally flat geometry. It will also be appreciated that the tubular extension member 60 of FIGS. 1 and 4 comprise substantially the same structure, and that the manner in which tubular extension member 60 of FIG. 4 connects with actuator 68 to form a leak-proof joint is the only difference with respect to tubular extension member 60 of FIG. 1.

To form a leak resistant joint at the generally, flat actuator face 67, tubular member 60 is preferably provided with another inner, ring-shaped gasket 72. Notably, gasket 72 is manufactured from substantially the same material as gasket 64 of FIGS. 3 and 4. Also, gasket 72 is provided with an aperture 61 in which tubular member 60 partially extends as is clearly illustrated at FIG. 4. Gasket 72 is rigidly retained at a tubular inlet end 59 adjacent fixed gasket 64 through a press fit at gasket aperture 61 in a manner to prevent movement thereof and to be contiguous with gasket 64.

In operation, tightening adjusting screw 48 permits portions of disk 57 to cooperate with confronting portions of inner surface 42 at aperture 58 to effect squeezingly attaching collar 36 and tubular extension member 60 to actuator 68 and orifice 70, respectively. The advancement of adjusting screw 48 exerts a squeezing force on disk 57 which is absorbed by gasket 64 through inner surface 42. Gasket 64 and tubular extension inlet portion 57 under the influence of the squeezing force bear against gasket 72, and act as a stay for preventing movement of gasket 72. Gasket 72 is compressed between gasket 64 and actuator face 67, such that, a thickness of gasket 64 is reduced. By this compression and associated reduction in thickness, the tubular extension inlet end projects or protrudes beyond gasket 64. Thus, openings defined by tubular extension inlet end and outlet orifice 59 and 70, respectively, are permitted to be precisely aligned with one another and matingly coupled. So joined, outlet orifice 70 and tubular member 60 form a leak resistant joint that satisfactorily transfers aerosol products to desired hard to reach locations. It will now be evident that reversibly moving or retracting tightening screw 48 releases the squeezing force and allows collar 36 and tubular extension member 60 to be dis-attached from actuator 68 and orifice 70, respectively.

Figure 5:
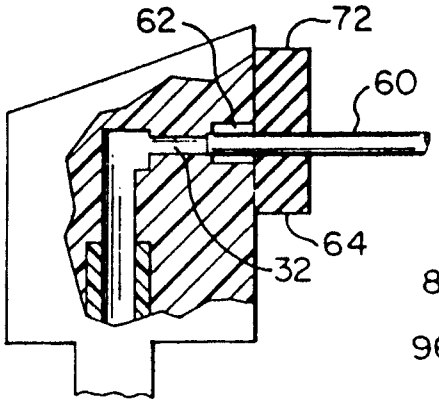
FIG. 5 is a similar view to FIG. 4, in which an outlet orifice thereof has an enlarged chamber for receiving therein a tubular extension member, and in which there is illustrated another variant of a connection of the tubular extension member of the aerosol extension to the outlet orifice of the actuator of FIG. 4.

Turning again to FIGS. 3 and 4, and especially FIG. 5, there is shown a particularly preferred variant of the connection of tubular extension member 60 of FIG. 4 to outlet orifice 32 of actuator 24, previously illustrated at FIG. 3. It will be appreciated that the only difference between outlet orifice 32 of FIGS. 3 and 5 is that enlarged orifice chamber 62 of FIG. 5 is of a size, to only snugly mate with or receive therein tubular inlet end 59. Moreover, the only difference between tubular extension member 60 of FIGS. 4 and 5 is that tubular extension member 60 of FIG. 5 includes only one gasket. In the illustrated form, tubular member 60 of FIG. 5 preferably includes only gasket 64.

Forming leak resistant joints with tubular extension member 60 of FIGS. 4 and 5 to outlet orifices 70, 32, respectively, is substantially the same. The primary difference in forming the leak resistant joint with respect to outlet orifices 70, 32 is that gasket 64 of FIG. 5 is not received within the enlarged chamber 62 of FIG. 5. In FIG. 5, chamber 62 only receives tubular inlet end 59, while gasket 64 under the compression of the squeezing force derived from screw 48 acts as a stay for preventing movement of tubular extension member, and creates the leak resistant joint thereof.

Figure 7:
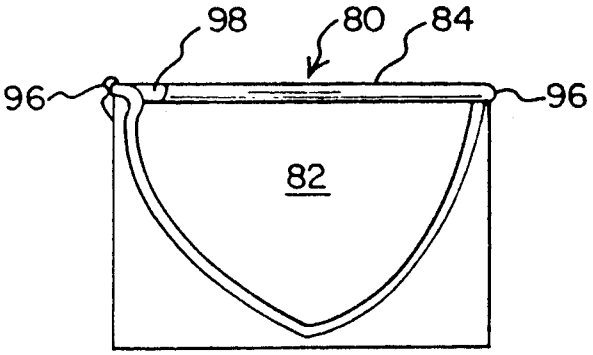
FIG. 7 is an enlarged, partially broken, cross-sectional, front view of the aerosol extension of FIG. 5.
Figure 6:
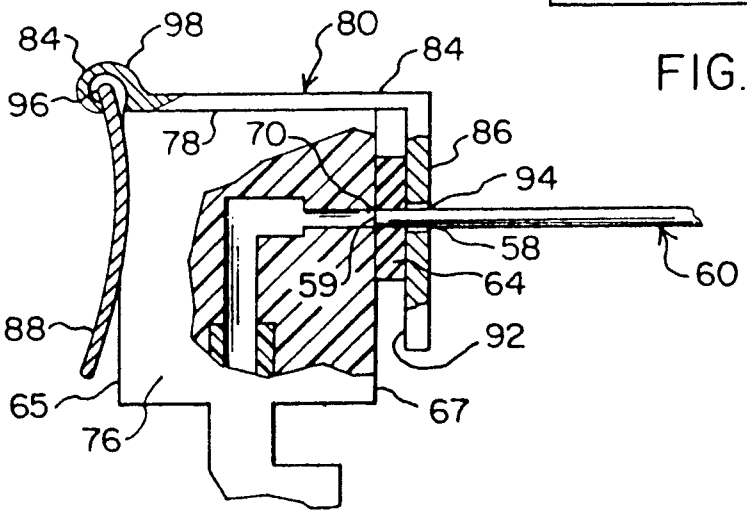
FIG. 6 is a similar view to FIG. 4 of still another actuator utilized by the spray system of FIG. 1, in which a top portion thereof is generally planar, and in which there is illustrated another embodiment of a connection of an aerosol extension to the spray system of FIG. 4.

Turning now to FIGS. 6 and 7, and particularly to FIG. 6, there is shown still another well-known actuator 76, which is commonly used by aerosol manufacturers. It will be apparent upon an inspection of FIG. 4 that the only difference between actuator 68 of FIG. 4 and actuator 76 of FIG. 6 is that actuator 76 comprises a generally flat top portion 78. There is also shown another embodiment of the aerosol extension of FIG. 2, which embodiment is generally donated by the reference numeral 80.

Aerosol extension 80 is in the form of a U-shaped plastic or metal clamp or clip member 82 for removably attaching to an actuator valve or nozzle 76 of aerosol 10. Clip member 82 is preferably made from plastic and comprises an upper intermediate section 84 and first and second side parallel sections 86, 88, respectively. First and second parallel sections 86, 88 extend from upper intermediate section 84 in a given longitudinal direction. First and second sections 86, 88 are also transversely spaced apart to form a gap 92 therebetween of sufficient size to matingly receive therein actuator 76, in a manner illustrated in FIG. 6.

Upper section 84 forms an intermediate bridge between first and second sections 86, 88, which extends transversely between first and second sections 86, 88 and is unitary therewith. First section 86 is provided with an aperture 94 for receiving therein tubular extension member 60, which member 60 is retained at aperture 94 by gasket 58 to prevent movement thereof. It will now be appreciated that tubular extension member 60 and gasket 64 are substantially constructed in the same manner and substantially perform the same function as previously fully described for valve extension 34 of FIG. 3.

In keeping with the invention, second section 88 functions as a locking means for releasably, snap-locking, aerosol extension 80 to actuator 76, and for locking tubular member 60, through its inlet end 59, in mating engagement with outlet orifice 70 to effect a leak-proof joint thereat. To permit locking, second section 88 comprises an elongated tubular member, which when viewed from a front thereof has a generally horseshoe-shaped, bar configuration, and when viewed from a side thereof has a concave configuration. Second section 88 is preferably made from plastic and is pivotally connected to upper section 84 at spaced apart ends 96 thereof.

In the illustrated attachment, upper section 84 comprises a detent in the form of a transversely extending recess or cavity 98. Cavity 98 is configured and dimensioned to allow second section 88 to snapingly bear against back side 65 of actuator 76, when rotated in a counterclockwise direction from a generally horizontal position to a generally vertical position relative to top portion 78 and back side 65. When snapped in position to bear against back actuator side 65, second section 88 and first section 86 cooperate to apply a squeezing or clamping pressure to opposed front and back actuator faces 67, 65 in a manner shown in FIG. 6. Moreover, detent cavity 98 mechanically holds second section 88 in abutting engagement with actuator back side 65, such that, the locking member or second section 88 can normally only be released therefrom through an application of manual force by rotating the locking member in a clockwise direction.

In operation, snapping second section 88 against actuator side 65 locks aerosol extension 80 to actuator 76 and applies a squeezing force to gasket 64 and tubular member 60. The squeezing force is transferred to front actuator surface 67 and an inner confronting surface of extension 80 defined by gap 92 so as to compress gasket 64. The application of pressure from second section 88 and the associated compression of gasket 64 enables tubular member 60 to be accurately mated to orifice 70, and enables gasket 64 to effect the leak resistant joint thereat.

It will now be appreciated that the present invention is not limited to locking aerosol extension 80 to actuator 70 through second section 88 and cavity detent 98. Other suitable locks as will occur to those skilled in the art may be utilized. For example, aerosol extension 80 could be locked to actuator 76 with a control or retainer belt or band made from an elastic material, such as rubber. It will be further appreciated that the present invention provides a low cost, reliable, simply constructed, easy to use, extension for spray applications with aerosol containers. Moreover, the present invention provides a simple, adjustable lock that is compatible with a number of aerosol containers having different spray system geometries or configurations, while allowing normal off-on control of the aerosol actuator. Lastly, the present invention, through its positive leak-proof coupling at the tubular extension member, aerosol orifice interface, advantageously allows a satisfactory transfer rate of product through the orifice and tubular extension member.

The foregoing description of a preferred embodiment of the aerosol extension invention has been presented for purposes of illustration and description. It is not intended to be exhaustive or to limit the invention to the precise form disclosed. Obviously, many modifications and variations are possible in light of the above teaching. For example, the instant embodiment was chosen and described in order to best explain the principles of the invention and its practical application to thereby enable others skilled in the art to best utilize the invention in various embodiments and with various modifications, as are suited to the particular use contemplated. It is intended that the scope of the invention be defined by the claims appended hereto.

I claim:

1. An aerosol extension for use with a pressurized container in domestic, industrial and general spray applications; said pressurized container having a cylindrically-shaped body with propellants and products for dispensing therewith, a planar bottom and a convex top; said convex top having a circular opening for receiving an actuator and a dispensing valve; said actuator and dispensing valve defining a dispensing system for delivering the products as a spray, a mist, a powder or a stream; said actuator defining an outlet orifice for delivering said products contained within said pressurized container; wherein the improvement comprises:

a. an annular clamping means for releasably locking said aerosol extension to the dispensing system; said clamping means being directly joined to said dispensing system with a ball and socket member without requiring physical engagement with the convex top, body, or bottom of said pressurized container; and b. a flexible, elongated, tubular member for accurately delivering products contained in said pressurized container from said dispensing system to intended locations otherwise difficult to reach with said products; said tubular member being retained by said clamping member relative to the outlet orifice; said tubular member being coupled between said clamping means and the actuator with the aid of said ball and socket member to effect efficient delivery of said products; and said ball and socket member being disposed within said clamping member to allow adjustably attaching said clamping member and said tubular member to said actuator and said outlet orifice, respectively.

2. The invention of claim 1, wherein said ball and socket member includes a force transmitting member, the force member transmitting member permitting a squeezing force to be adjustably transmitted in all directions to front and back regions of said actuator and to a connection of said tubular member and said outlet orifice; said squeezing force enabling said clamping member and said tubular member to be positively locked to said dispensing system while leaving said actuator free for stopping and starting product dispensing spray operations.

3. An aerosol extension for use with a pressurized container in domestic, industrial and general spray applications; said pressurized container having a cylindrically-shaped body with propellants and products for dispensing therewith, a planar bottom and a convex top; said convex top having a circular opening for receiving an actuator and a dispensing valve; said actuator and dispensing valve defining a dispensing system for delivering the products as a spray, a mist, a powder or a stream; said actuator defining an outlet orifice for delivering said products contained within said pressurized container; wherein the improvement comprises:

a. a clamping means for releasably locking said aerosol extension to the dispensing system; said clamping means being directly joined to said dispensing system; and b. a flexible, elongated, tubular member for accurately delivering products contained in said pressurized container from said dispensing system to intended locations otherwise difficult to reach with said products; said tubular member being coupled between said clamping means and said dispensing system to effect efficient delivery of said products; and wherein said clamping means is directly joined to said dispensing system without requiring physical engagement with the convex top, body, or bottom of said pressurized container; and wherein said clamping means comprises a ring shaped configuration and defines opposed inner and outer surfaces; said clamping means including a first aperture for receiving said tubular member and retaining said tubular member relative to the outlet orifice of said actuator; and, wherein said clamping means includes an inner button member for assisting in positively, releasably locking said extension to said dispensing system; said button member being adapted for adjustably exerting pressure on a first region of said dispensing system; said button member also being adapted to adjustably exert a pressure against a terminal end portion of said tubular member, when said tubular member is located at said outlet orifice, to effect locking said tubular member to said orifice; said clamping means and said button member enabling said tubular member to be locked to said orifice, while permitting said dispensing system to be actuated and said product to be transferred from said orifice through said tubular member.

4. The invention of claim 3, wherein said clamping means includes a locking member for adjustably locking and maintaining said tubular member in alignment with said orifice; said locking member comprising an adjusting screw; said adjusting screw being threadally connected to said clamping means in a manner to extend through said opposed inner and outer sides of said clamping means and to engage said button member; and said adjustable screw being enabled to advance radially inwardly to allow said button member to lock said tubular at said orifice when said adjustable screw is tightened.

5. The invention of claim 4, wherein said button member includes a socket for receiving a ball disposed at an end of said adjusting screw; the ball and socket connection of said button member and said adjusting screw allowing pressure to be exerted on said button member in any direction; said button member after receiving said pressure applied by said adjusting screw being enabled to transmit a clamping force to said first region of said dispensing system and an opposed second region of said dispensing system; said clamping force being transmited causing said extension to be locked to said dispensing system and said tubular means to be locked to said orifice.

6. The invention of claim 5, wherein said tubular member extends through a second aperture adjacent said clamping means, said tubular member being disposed in said second aperture to allow an inlet portion of the terminal end of said tubular means to engage said orifice of said dispensing system; said tubular member being removably retained within said second aperture with a retainer ring at a portion thereof intermediate said inlet portion of said terminal end of said tubular means and an outlet portion of said tubular means.

7. The invention of claim 6, wherein said tubular member includes a first resiliently, flexible and compressible gasket for forming a connection at said terminal end of said tubular member and said orifice; said connection being resistant to undesirable leaking from said products and propellants, when said tubular member is locked in engagement with said orifice; said first gasket being retained on said tubular member to prevent movement thereof, and to bear against a portion of said inner surface of said clamping means.

8. The invention of claim 7, wherein said first gasket is compressed between said inner surface of said clamping means and said orifice by said clamping pressure exerted by said button member; said clamping pressure being transferred from said button member to confronting regions defined by said orifice and portions of said inner surface of the clamping means bearing on said first gasket to enable said first gasket to be compressed; said compressed first gasket assisting in maintaining said inlet terminal portion of said tubular member in mating alignment with said orifice, and assisting in effecting a leak-proof seal at said connection between said terminal inlet end of said tubular member and said orifice.

9. The invention of claim 8, wherein said pressurized container is an aerosol container.

10. The invention of claim 9, wherein said inlet terminal end of said tubular member and said first gasket are both sized to be inserted and seat within internal confines defined by said orifice.

11. The invention of claim 10, wherein said first gasket comprises a rubber material.

12. The invention of claim 11, wherein said clamping member comprises plastic material.

13. The invention of claim 12, wherein said tubular member comprises polyethylene or polypropylene material.

14. A nozzle extension for use with a pressurized aerosol package; said package comprising: dispensable products therein, a propellant system, and a nozzle for delivering products as a stream, a mist, a powder or a spray; said nozzle defining an outlet passageway for producing a desired flow pattern; said passageway having a uniform diameter so as to define a generally, flat, nozzle face free of an enlarged chamber at an terminal end thereof; wherein the improvement comprises:

a. a nozzle fastener member for removably attaching said extension to the nozzle; said fastener member comprising: first and second parallel sections extending in a given longitudinal direction; said first and second parallel sections being spaced apart transversely to form a gap therebetween for receiving said nozzle therein; and an upper intermediate bridge section extending transverse to said first and second parallel sections and being unitary therewith;

b. one of said first and second parallel sections of said fastener member comprising an aperture for receiving and retaining therein an elongated, flexible, tubular member; said retained tubular member being enabled to engage said nozzle member, when said extension is attached to said nozzle so as to permit the product to be received therein and transferred through said extension to a desired location otherwise difficult to reach with said product;

c. said tubular member including a seal member reposed thereon adjacent the one parallel section retaining said tubular member; said seal member being compressed between said one parallel section retaining said tubular member and said nozzle face, when said nozzle fastener is attached to said nozzle; said compressed seal member forming a leak-resistant joint at the engagement of said extension member with said passageway with respect to propellants and said products being transferred through said extension member; and d. a remaining one of said first and second parallel sections of said fastener comprising a releasable, adjustable, locking means for said attaching nozzle extension onto said nozzle; said locking means permitting a squeezing pressure to be applied to said nozzle through said first and second parallel sections, when said nozzle is received in the gap therebetween, to effect said attaching said nozzle extension to said nozzle; and an application of said squeezing pressure to said first and second parallel sections through said locking means enabling said retained tubular member to be accurately mated to said passageway, and allowing said seal member to said compress and effect said leak-resistant joint.

15. A valve extension for use with a device for dispensing products as a stream, a powder, a mist or a spray; said device including: a pressurized receptacle, a dispensable product with a compressed gas propellant; and a valve system for producing and dispensing the products from said device; said valve system defining an orifice for said dispensing said products; the orifice being free of chambers, chamfers and recesses so as to provide the valve system with a generally, planar face; wherein the improvement comprises:

a. an elongated, flexible, annular, extension member, said extension member having intake and outlet end portions for transferring said products from said valve system through said extension member to a desired location otherwise difficult to reach with minimal loss of said products and propellants during said dispensing of said product; said annular extension member being mounted at said valve extension to permit alignment with and connection to said orifice of said valve system;

b. said valve extension including first and second sleeve members positioned intermediate inner confronting surfaces of said orifice and said valve extension for maintaining said annular extension member and said orifice in alignment, and for forming a joint substantially resistant to a nondesired leakage of products and compressed fluids, while said products are being dispensed; the first sleeve member being hard and being rigidly secured around said annular extension member in a manner to be contiguous with said second sleeve member; said first sleeve being flexibly resilient and being disposed around said annular member; said first sleeve including an aperture therein for communicating with said outlet orifice, and for receiving said intake portion of said annular extension member therein;

c. a locking member for adjustably locking said valve extension onto said valve system; said locking member comprising a collar; said collar including an aperture for allowing said annular extension member to extend therethrough; said collar member securing said annular extension member at said aperture to prevent movement thereof, and permitting said intake portion of said tubular member to be in line with said orifice, when said collar is locked to said valve system;

d. an adjusting means movably connected to said collar to effect attaching said collar to said valve system, and attaching said annular extension member in mating engagement with said orifice; said adjusting means being controllably movable to enable said collar to be releasably clamped around said valve system to effect attaching said valve extension and said annular member to said valve system and said orifice, respectively; and e. a disk member connected to said adjusting means to enable confronting portions of said collar and said disk member to effect squeezingly attaching said collar and said annular extension member to said valve system and said orifice, respectively.

16. The invention of claim 15, wherein said adjusting means when advanced in a first direction exerts a squeezing force to said valve system and said orifice through said confronting portions of said collar and said disk member; said squeezing force acting on said second sleeve, wherein said second sleeve under an influence of said squeezing force bears against said first sleeve to cause said first sleeve to compress; such that, said orifice and said annular extension member are permitted to be positioned in line with one another and mating engaged to form said leak-proof joint.

17. The invention of claim 16, wherein said adjusting means, when moved in a second reverse direction, releases said squeezing force to allow said collar and said annular extension member to be dis-attached from said valve system and said orifice, respectively.

* * * * *